US005979484A

United States Patent [19]

Grando et al.

[11] Patent Number: 5,979,484

[45] Date of Patent: Nov. 9, 1999

[54] SAFETY AND REGULATION VALVE UNIT FOR A GAS INSTALLATION PARTICULARLY A HEATING INSTALLATION

[75] Inventors: Maurizio Grando, Chirignago; Michele Bortoliero, Monselice; Vanni Gallocchio, Abano Terme, all of Italy

[73] Assignee: OP Controls S.r.l., Padua, Italy

[21] Appl. No.: 09/066,759

[22] Filed: Apr. 28, 1998

[30] Foreign Application Priority Data

Apr. 30, 1997 [IT] Italy ..... PD97A0096

[51] Int. Cl.[6] ..... F16K 11/10

[52] U.S. Cl. ..... 137/66; 137/866; 137/870; 251/129.11

[58] Field of Search ..... 137/66, 866, 868, 137/870; 251/129.11; 431/54

[56] References Cited

U.S. PATENT DOCUMENTS 2,901,034 8/1959 Puttfarcken et al. ..... 137/66 X
4,437,388 3/1984 Budzich ..... 251/129.11 X
4,526,342 7/1985 Wakefield ..... 251/129.11 X
5,785,511 7/1998 Shah ..... 431/54 X

*Primary Examiner*—Gerald A. Michalsky
*Attorney, Agent, or Firm*—Sughrue, Mion, Zinn, Macpeak & Seas, PLLC

[57] ABSTRACT

A safety and regulation valve unit for a gas installation, particularly a heating installation, comprises a duct through which the fuel can flow between an inlet and at least one outlet. An on-off fuel-valve is interposed in the duct between the inlet and the at least one outlet, and there is a movable device for controlling the valve as well as an actuator acting on the movable device in order to move it towards a first operative position in which it cooperates with the on-off valve in order to put the inlet into communication with the outlet. The actuator comprises a reversible motor with a rotor connected to a male-and-female screw coupling acting on the movable device to translate it towards the first operative position and to control the on-off valve.

9 Claims, 2 Drawing Sheets

SAFETY AND REGULATION VALVE UNIT FOR A GAS INSTALLATION PARTICULARLY A HEATING INSTALLATION

BACKGROUND OF THE INVENTION

The present invention relates to a safety and regulation valve unit for a gas installation, particularly a heating installation, comprising a duct through which the fuel can flow between an inlet and at least one outlet, on-off fuel-valve means interposed in the duct between the inlet and the at least one outlet, a movable device for controlling the on-off valve means, as well as actuator means acting on the movable device in order to move it towards a first operative position in which it cooperates with the on-off valve means in order to put the inlet into communication with the at least one outlet.

Valve units of the known type indicated above are normally operable manually or by means of electromagnetic control devices. In particular, in units operable by means of electromagnetic devices, the movement of the movable device can be controlled automatically. However, this control is achieved with the use of fairly complex electronic systems which generally operate by regulating the supply voltage of the control device. Moreover, with these systems fairly low forces and small movements of the movable device are achieved.

SUMMARY OF THE INVENTION

In order to overcome these problems, the subject of the invention is a unit of the type defined above, characterized in that the actuator means comprise a reversible motor with a rotor connected to a male-and-female screw coupling acting on the movable device to translate it towards the first operative position and to control the on-off valve means.

By virtue of this characteristic, the valve unit according to the invention is particularly simple and reliable in use and permits improved control of the movement of the movable device.

BRIEF DESCRIPTION OF THE DRAWINGS

Further characteristics and advantages of the invention will become clearer from the following detailed description, provided purely by way of non-limiting example and given with reference to the appended drawings, in which.

DETAILED DESCRIPTION OF THE INVENTION

Figure 1:
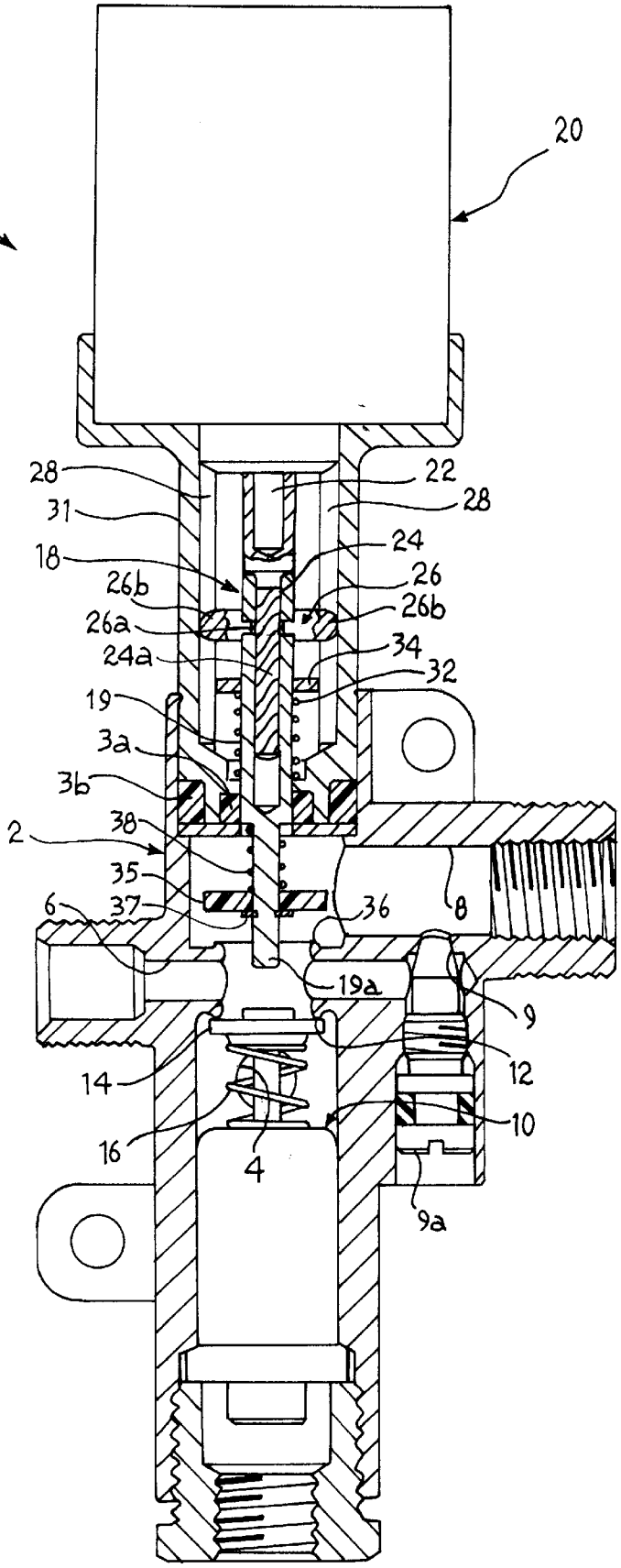
FIGS. 1 to 4 are sectioned side elevational views of a valve unit according to the invention in various operating conditions.

With reference initially to FIG. 1, a valve unit according to the invention is generally indicated 1. The unit 1 comprises a duct 2 into which fuel is supplied through an inlet 4 partially visible in the drawings.

The fuel coming from the inlet 4 can be sent to a burner of known type, not shown in the drawings, through a main outlet 6 of the duct 2 or through the outlet 6 and an auxiliary outlet 8 axially offset along the duct 2 relative to the outlet 6.

A communication duct between the outlets 6 and 8 is indicated 9 and a screw 9*a* is mounted therein for regulating the minimum flow of fuel supplied through the outlet 8.

Valve means 10 are associated with the duct 2 for intercepting the fuel coming out of the inlet 4. The valve means

10 are normally constituted by a solenoid valve of known type with a thermocouple circuit and having a movable closure member 14 urged by a spring 16 towards a position of engagement with a valve seat 12 formed in the duct 2. Alternatively, the valve means 10 may simply comprise a movable closure member urged into closure on the valve seat 12 by a spring.

A movable device 18 is slidable in a leaktight manner in a housing 31 formed as an extension of the duct 2. For this purpose, annular seats 3*a* are provided inside the housing 31 which in turn is fitted on the duct 2 in a leaktight: manner by means of sealing rings 3*b*. Alternatively, the housing 31 may be formed integrally with the duct 2. The movable device 18 includes an axially hollow shaft 19 having an operating end 19*a*. The axial cavity of the shaft 19 houses an externally threaded rod 24 coaxial with and connected rigidly to the output shaft of the rotor 22 of an electric motor 20 associated with the unit 1. The motor 20 is preferably a direct-current electric motor, for example, of the stepping type. The rod 24 is coupled directly to the shaft of the rotor 22 with a unitary transmission ratio.

The rod 24 preferably has helical grooves jointly defining a threaded profile 24*a*.

A female threaded element 26 connected to the shaft 19 at the opposite end to the end 19*a* has an internal thread 26*a* which can engage the thread of the rod 24. The female threaded element 26 further comprises a pair of diametrally-opposed radial appendages for engaging respective axial slots 28 formed in a portion of the housing 31. The female threaded element 26 is guided for sliding axially relative to the rod by virtue of the engagement of the slots 28 by the appendages 26*b*, so that a rotation of the rod 24 causes corresponding axial sliding of the shaft 19 relative to the rod, by virtue of the mutual engagement of the threads 24*a* and 26*a*.

A helical biasing spring 32 fitted on the rod 19 acts between a shoulder of the housing 31 and a washer 34 mounted coaxially on the outside of the shaft 19 and movable axially relative thereto. The spring 32 is mounted with a resilient preloading such as to keep the washer 34 in abutment with a radial surface of the housing 31, not shown.

A second, annular plate-shaped closure member 35 is mounted on the shaft 19 in the region of the end 19*a* and can close a valve seat 36 which puts the main outlet 6 into communication with the auxiliary outlet 8. The closure member 35 is mounted for sliding on the shaft 19 and the resilient preloading of a spring 38 acting between the closure member 35 and a shoulder of the shaft keeps the closure member axially in abutment with a stop ring 37 force fitted on the shaft 19.

When the unit 1 is in operation, the movable device 18 can adopt a plurality of operative positions.

In FIG. 1, the unit is shown in an inoperative configuration in which the closure member 14 of the valve 10 is urged into closure on the seat 12, intercepting the flow of fuel between the inlet 4 and the outlets 6 and 8.

Figure 2:
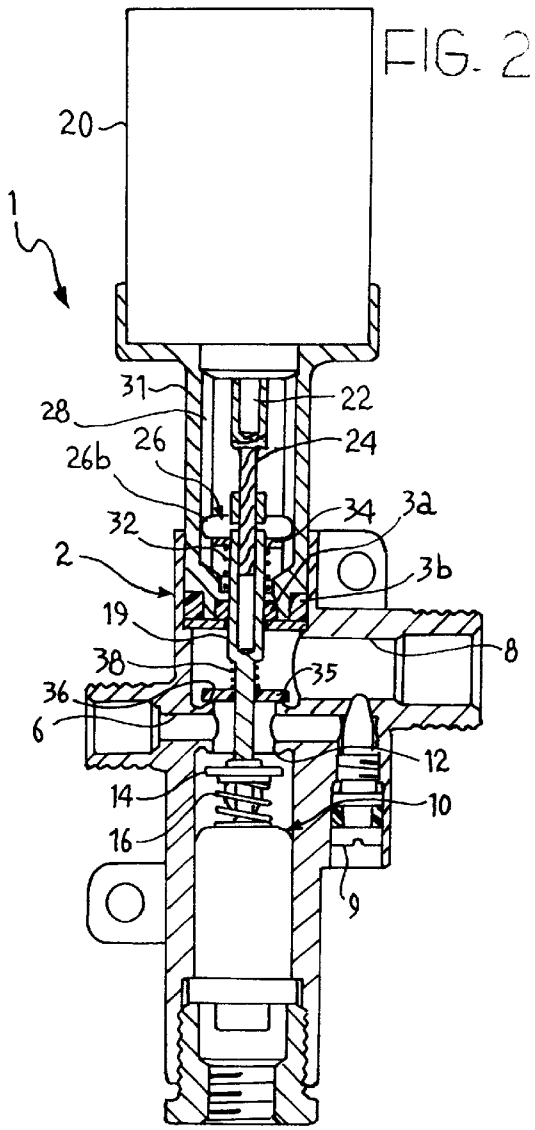

During a lighting stage of the installation, the unit 1 is brought to the configuration of FIG. 2, starting from that shown in FIG. 1. In order to reach the configuration of FIG. 2, a control device, not shown, activates both a discharge device, for example, of the known piezoelectric type, in order to light the flame of the burner of the installation, and a timing device or timer, likewise not shown in the drawings.

At the same time, the electric motor 20 is rotated, for example, anticlockwise, as a result of the supply of an electrical voltage thereto. The shaft 19 of the movable device 18 is thus moved axially towards the closure member 14, owing to the rotation of the rod 34 relative to the female threaded element 26, until its end 19*a* interferes with the closure member 14, exerting a pressure thereon against the action of the spring 16, thus causing the closure member 14 to move relative to the seat 12.

During the movement of the device 18, the spring 32 is compressed by the washer 34 which in turn is moved axially by the internally threaded member 26. The washer 24 remains in abutment with the female threaded member because of the resilient load exerted by the spring 32.

As a result of the movement of the closure member 14 away from the seat 12, the fuel inlet 4 is brought into communication with the outlet 6 which, as stated above, is connected to the burner, so that the fuel is lit by the discharge device. As a result of the axial movement of the shaft 19, the closure member 35 is closed onto the corresponding valve seat 36 and is urged into this closure position by the resilient action generated by the compression of the spring 38 (FIG. 2). As a result, the auxiliary outlet 8 is not in communication with the outlet 6, that is, it is put into communication solely through the minimum-flow regulation duct 9.

As a result of the lighting of the fuel, the thermocouple heats up, generating a current which magnetically locks or arms the closure member 14 in the position reached, spaced from the seat 12.

Upon completion of the lighting of the burner and the consequent locking of the closure member 14 of the valve 10 in the open position, and hence after a predetermined time set by means of the timer has elapsed, both the voltage supply to the motor 20 and the lighting discharge are stopped.

Figure 3:
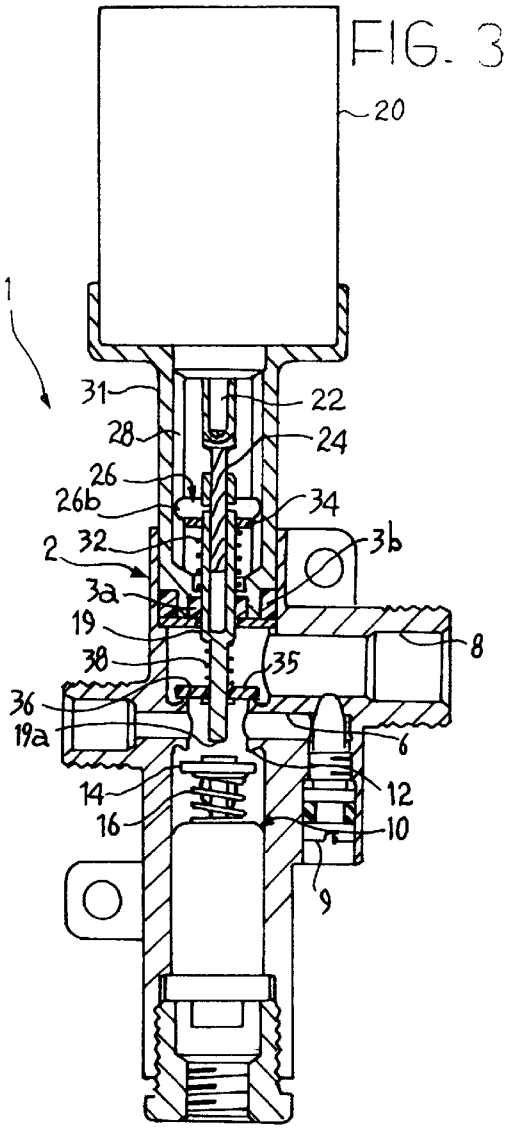

In this condition, the motor 20 is idle and the shaft 19 is urged in the opposite direction to that of the lighting stage by the resilient biasing force stored in the helical spring 32 so that the movable device 18 is returned towards the motor 20 and away from the valve 10 until it reaches a "rest" position shown in FIG. 3. This position is defined by the abutment of the washer 34 with the corresponding abutment surface of the housing 31. The washer 34 is in abutment with this surface since it is acted on by the resilient preloading of the spring 32.

The resilient characteristic of the spring 38 is such that, when the movable device 18 is in the rest position of FIG. 3, the closure member 35 is kept closed on the corresponding valve seat 36 by a predetermined resilient load of the spring 38, thus intercepting the flow of fuel through the valve seat 36. In this position, which is defined as the "minimum power" position, the shaft 19 cuts off the outlet 8 by means of the closure member 35 and the fuel inlet 4 is in communication with the main outlet 6.

The helical spring 32 also performs a safety function for the unit 1. In fact, if the motor stops accidentally during the lighting of the installation, the spring 32 returns the shaft 19 to a position spaced from the closure member 14 so that the closure member 14 is automatically urged into closure on the seat 12 by the spring 16, thus preventing the shaft 19 from stopping in a position in which it could interfere with the closure member 14, keeping it spaced from the seat 12.

Figure 4:
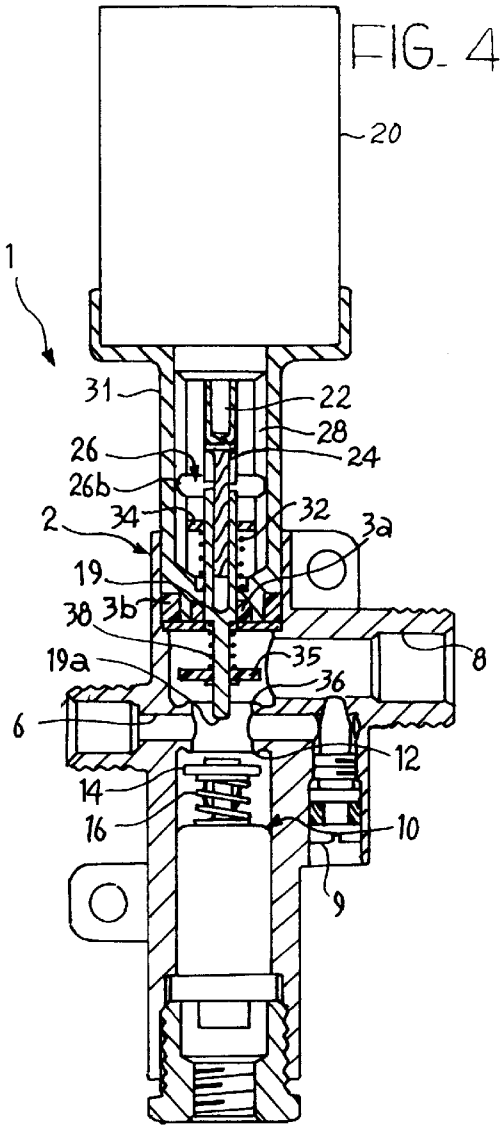

The shaft 19 can also adopt a second operative position called the "maximum power" position, shown in FIG. 4, in which the inlet 4 is simultaneously in communication with both of the outlets 6 and 8. In order to bring the shaft 19 to this position, the motor 20 is activated again in the opposite direction of rotation to that of the lighting stage, for example, as a result of the reversal of its poles. The shaft 19 is thus retracted to a position in which it is spaced from the rest position and in which the closure member 35 is moved so as to open the valve seat 36 and to allow fuel to pass through the auxiliary outlet 8.

The "minimum power" position can be reached from the "maximum power" position if a voltage is supplied to the motor 20 again so as to cause it to rotate in the same direction as in the lighting stage until the auxiliary outlet opening 8 is blocked.

Moreover, whatever position the movable device 18 is in, the installation can be turned off by the interruption of the thermocouple circuit so as to de-energize the thermostatic solenoid valve 10 so that the closure member 14 is subject to the thrust of the spring 16 and is urged into closure on the seat 12, thus cutting off the fuel supply.

What is claimed is:

1. A safety and regulation valve unit for a gas installation, particularly a heating installation, comprising a duct through which the fuel can flow between an inlet and at least one outlet, on-off fuel-valve means interposed in the duct between the inlet and the at least one outlet, a movable device for controlling the on-off valve means, as well as actuator means acting on the movable device in order to move it towards a first operative position in which it cooperates with the on-off valve means in order to put the inlet into communication with the at least one outlet, characterized in that the actuator means comprise a reversible motor with a rotor connected to a male-and-female screw coupling acting on the movable device to translate it towards the first operative position upon rotation of the motor in one direction and to control the on-off valve means and first resilient biasing means acting on the movable device in order to urge it towards a rest position spaced from the first operative position.

2. A valve unit according to claim 1, in which one or other of the male screw and the female screw is connected to the rotor of the motor by a direct coupling with a unitary transmission ratio.

3. A valve unit according to claim 1, in which the motor is a direct-current electric motor.

4. A valve unit according to claim 1, in which the actuator means comprise a rod fixed for rotation with the rotor and in screwing engagement with the female screw, and the movable device comprises a control shaft connected rigidly to the female screw and fixed for translation therewith.

5. A valve unit according to claim 4, in which guide means are provided in the duct for guiding the shaft of the movable device axially towards the operative position as a result of a rotation of the rod about its own axis.

6. A valve unit according to claim 1, in which the resilient biasing means comprise a helical spring which can store a biasing force as a result of the rotation of the electric motor in a first direction of rotation and of the consequent translation of the movable device towards the first operative position, and which can release the biasing force when the rotor of the electric motor is idle, in order to return the movable device towards the rest position.

7. A valve unit according to claim 1, in which the duct has a main outlet and at least one auxiliary outlet as well as second valve means interposed between the main and auxiliary outlets, the second valve means being controlled by the movable device which can adopt a second operative position upon rotation of said motor in an opposite direction in which the inlet is simultaneously in communication with the main outlet and with the auxiliary outlet.

8. A unit according to claim 7, in which the second valve means comprise a closure member mounted on the shaft of the movable device, second resilient means acting on the closure member in order to urge it into closure on the corresponding valve seat in the first operative position as well as in the rest position of the movable device.

9. A valve unit according to claim 1, further comprising means for locking the on-off valve means in an open position upon movement of the moveable device to the rest position.

* * * * *